US007290483B2

(12) United States Patent
Belvis et al.

(10) Patent No.: US 7,290,483 B2
(45) Date of Patent: Nov. 6, 2007

(54) STRAP DIRECTING DEVICE

(75) Inventors: Eufrocinio Q. Belvis, Addison, IL (US); Lawrence J. Promise, Matteson, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 99 days.

(21) Appl. No.: 11/149,096

(22) Filed: Jun. 9, 2005

(65) Prior Publication Data

US 2006/0278752 A1 Dec. 14, 2006

(51) Int. Cl.
*B65B 13/00* (2006.01)

(52) U.S. Cl. ..... 100/7

(58) Field of Classification Search ..... 100/7, 100/8, 25, 26, 29; 242/397, 397.5, 548.2, 242/566, 615.2, 615.3, 421.8; 53/589, 389.2, 53/389.4

See application file for complete search history.

(56) References Cited

U.S. PATENT DOCUMENTS 2,838,252 A * 6/1958 Tomasch ..... 242/421.8
3,162,394 A * 12/1964 Culpepper et al. ..... 242/420.6
5,168,686 A * 12/1992 Guttinger ..... 53/399
6,105,344 A 8/2000 Maeda et al.
6,233,910 B1 * 5/2001 Hataya ..... 53/589
6,640,700 B2 * 11/2003 Helland et al. ..... 100/26

FOREIGN PATENT DOCUMENTS

DE 19641855 4/1997
EP 0928742 7/1999

OTHER PUBLICATIONS

European Search Report for EP06252742 dated Jul. 5, 2006 (2 pages).

* cited by examiner

*Primary Examiner*—Shelley M. Self
(74) *Attorney, Agent, or Firm*—Mark W. Croll; Donald J. Breh; Levenfeld Pearlstein, LLC

(57) ABSTRACT

A guide for guiding strap material from a dispenser to a strapper directs strap between the dispenser and strapper when in different positions in relation to each other. The guide includes an element having an open central passage defining a pathway for strap material to pass therethrough. The guide receives strap material in a first direction, and allows the strap material to exit in a second direction. The guide has bearing surfaces that define the passage so that when the strap material changes directions, there is minimal friction between the strap and the guide.

11 Claims, 4 Drawing Sheets

STRAP DIRECTING DEVICE

BACKGROUND OF THE INVENTION

The present invention pertains to a strap directing device. More particularly, the invention pertains to a device capable of guiding the strap payoff from a strap dispenser in multiple directions without having to reposition the dispenser.

It is often desirable to strap loads of objects in order to facilitate handling and transport of those items. Strappers are in widespread use to, for example, position and tension strap material around a load. Often times, it is desirable to strap large, oversized loads such as a large stack of cardboard items or a bale of textile material. It can also be desirable to strap a large number of loads.

In order to meet the requirements of strapping large loads or a large number of loads, relatively large, commercial strappers have been developed. One exemplary strapper is disclosed and described in pending U.S. application Ser. No. 11/051,420 to Balling et al. Such a strapper includes generally a frame, a platen that is mounted to the frame, a strap feed guide, a feed head, a strap chute, and a strapping head. Associated with the strapper is a dispenser that feeds strap material to the strapper. Generally, the feed head draws the strap material from a dispenser, feeds the strap material through the guide to the strapping head, into and around the strap chute, and back to the strap head. Also, a slack box can be used to provide a supply of readily available strap material S for the feed head.

As can be expected, many commercial strappers are large, heavy machines composed of many parts. Many of these machines are difficult and practically impossible to move due to their sizes and weights. In addition, commercial strappers generally strap a large number of loads. To function relatively continuously, they require a large amount of strap material. In order to meet the demand for strap material, large dispensers have been used. However, like the strappers themselves, these commercial dispensers are often large and heavy. It can be difficult and time consuming to substitute one dispenser for another, or to outfit a dispenser with additional strap material. It is thus desirable to have a system where more than one dispenser is set up to feed into the one strapper.

In other circumstances, one may want to use one dispenser to alternatively feed into different strappers. Unfortunately, known dispensers are only capable of feeding strap material in one angular direction. Further, strappers can be limited in the orientation of the strap material that they are fed. These limited capabilities generally require that only one dispenser be lined up with one strapper.

Accordingly, there exists a need for a mechanism that allows for changing the direction if strap fed from a dispenser to a strapper. Desirably such a device permits the use of multiple dispensers to feed into one strapper easily and safely. Desirably, such a mechanism includes a strap guide that is capable of cooperating with a dispenser to deliver strap material to one or more strappers.

SUMMARY OF THE INVENTION

A multi direction payoff strap guide cooperates with a dispenser and a strapping machine (or strapper) to redirect strap material into the strapper. In one embodiment, the strap guide generally includes a hollow, tubular element capable of allowing strap material to be drawn from a range of directions (angles) including from about 90 degrees left of normal through about 90 degrees right of normal.

A conventional strapper includes a dispenser frame and a cylindrical element or reel mounted to the frame for rotation. The reel holds a spool of strap material. The strap material is fed from the spool tangential to the spool. The strap guide is positioned functionally between the dispenser and the strapper. Preferably, the strap guide is aligned with the spool such that it is in the same radial plane as the strap material being fed from the spool.

The strap guide includes a hollow element with an entrance and an exit that defines a sleeve. The sleeve can be formed as a square or rectangular tube. The strap guide includes bearing surfaces (such as pin or roller bearings) at the internal sides of the tubing at the entrance and the exit. The strap guide is configured to allow the strap material to pass through the hollow element, and exit the strap guide in a wide range of directions. The strap guide is located functionally between the dispenser and the strapper.

In an alternate embodiment, the guide is formed from a ring or loop having bearing surfaces formed as rounded edges or having a toroidal or elongated toroidal shape.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
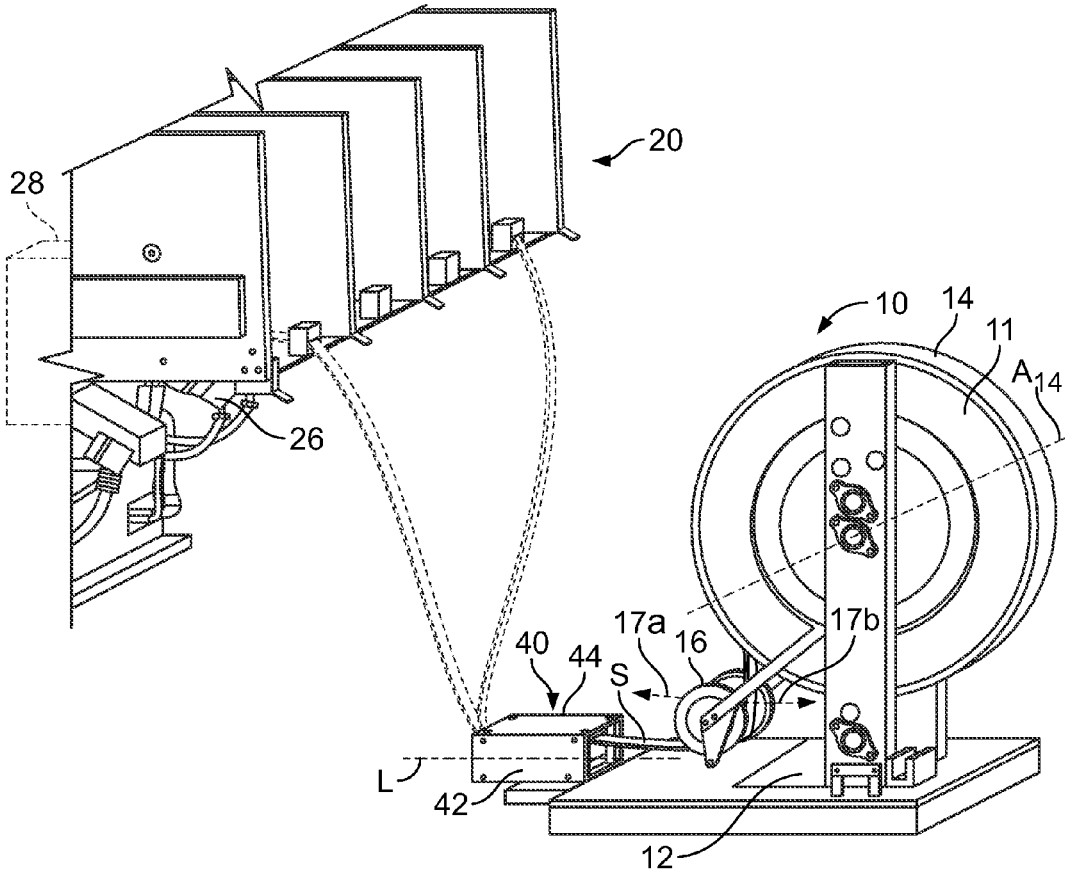
FIG. 1 is a perspective view of an exemplary strapper system illustrated with one embodiment of a multi direction strap payoff guide located between the strapper.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Figure 2:
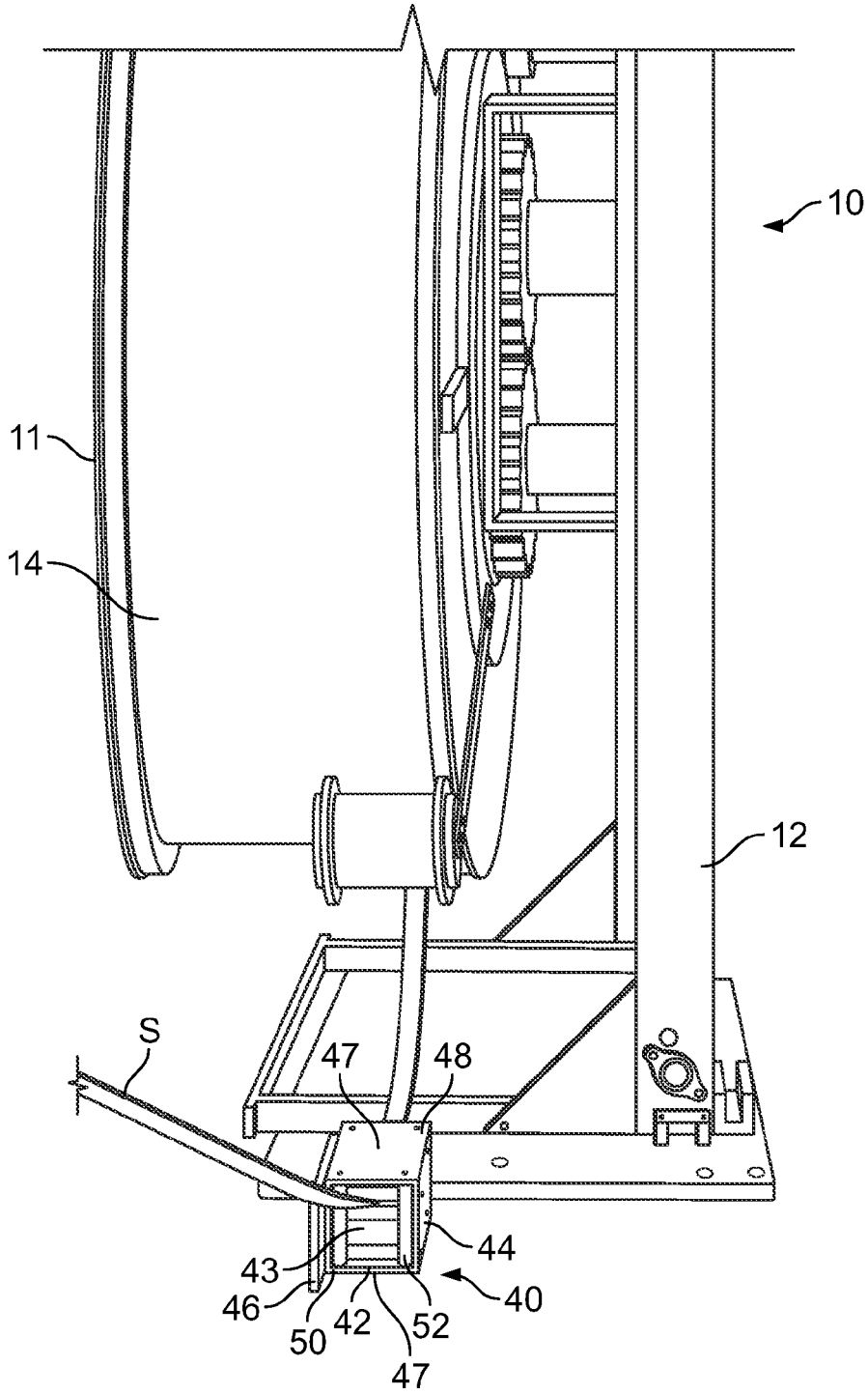
FIG. 2 is a front view of the dispenser showing the multi direction strap payoff guide.

Referring now to the figures and in particular to FIGS. 1 and 2, there is shown a payoff guide 40. The payoff guide 40 is operationally positioned between a dispenser 10 and a strapper 20. A typical dispenser 10 includes a frame 12 having a cylindrical element or reel 11 mounted to the frame 12. A spool 14 of strap material is mounted to the reel 11. The dispenser 10 can also include a secondary element 16 mounted to the reel 11 and frame 12 to accommodate and tension and to take up slack strap material.

The spool 14 holds a supply of strap material S, and is capable of feeding the strap material S at an angle normal to the spool 14. Essentially, the strap S comes off of the spool 14 tangential to the spool 14. The tension/slack take up element secondary feeding element 16 is positioned to receive strap material S from the spool 14 and to provide an accommodation to take-up slack strap material that is pulled from the spool but not yet demanded by the strapper, and to provide a quantity of strap material available for the strapper without rapidly commencing rotation of the spool (which requires a large "pulling" force). The take up element 16 rotates about the same axis $A_{14}$ as the spool 14, as indicated by the arrows at 17*a* and 17*b*, is biased in the rearward direction 17*b*. The rearward direction 17*b* also serves to brake the rotating reel 11 and spool 14. The strap S is threaded around the take up element 16 such that as strap is demanded, it pulls the element 16 in the forward direction 17*a*, which releases the breaking function to allow the reel 11 and spool 14 to rotate.

The payoff guide 40 receives strap material from the dispenser 10 via the take up element 16. The payoff guide 40 includes a hollow element or sleeve 42 having an open central passage 43 which is capable of allowing the strap material S to pass through the payoff guide 40 to the strapper 20. The strapper 20 is a device that passes strap material S around a load, tensions the strap and seals the strap to itself to contain or bundle the load. A typical strapper includes a feed head 26 mounted to the strapper 20 and a slack box 28 adjacent to the feed head 26, into which strap S is fed or pulled from the dispenser 10. From the feed head 26, the strap material S is fed or pulled into a chute (not shown) around the load, tensioned and sealed to itself.

Figure 3:
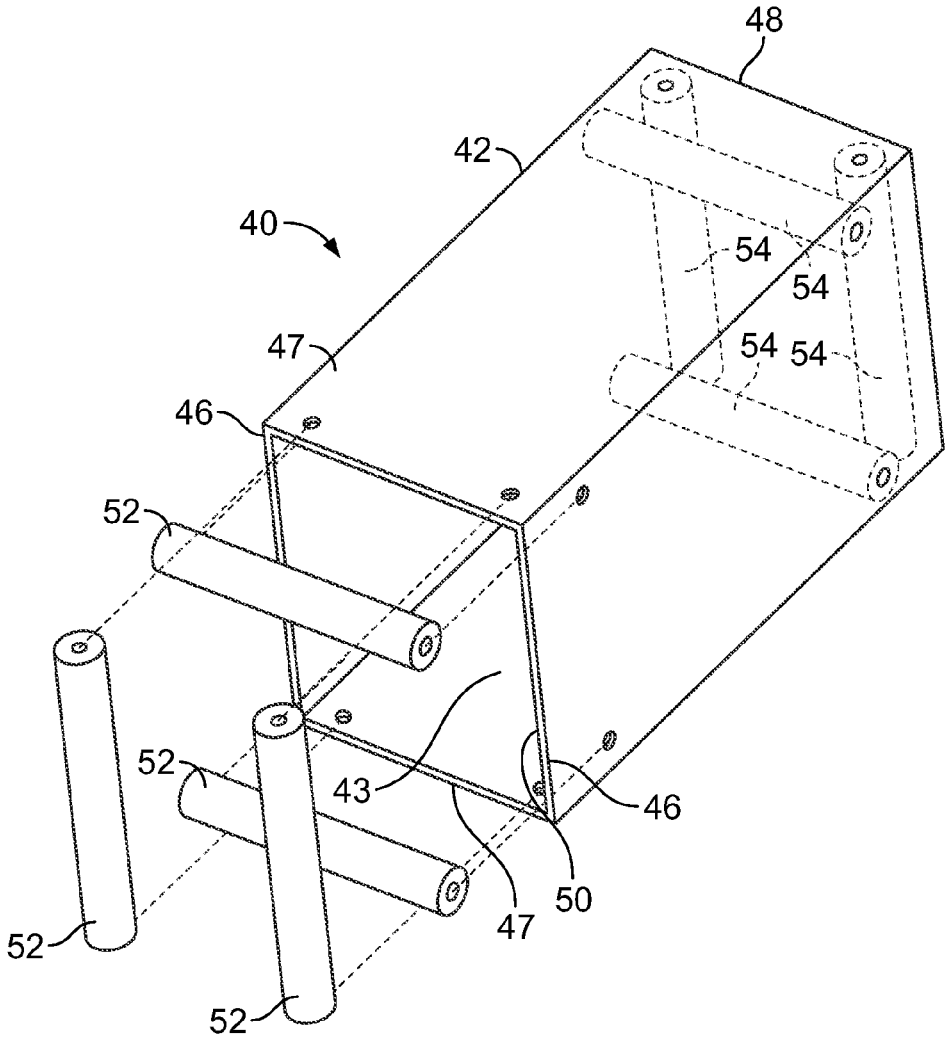
FIG. 3 is a partial exploded view of the multi direction payoff guide.

Referring now to FIGS. 1-3, the payoff guide 40 is operationally positioned between the dispenser 10 and the strapper 20. The guide 40 preferably includes a hollow element or sleeve 42 that defines a pathway for the strap material S to pass though. Preferably, the sleeve 42 is defined by a rectangular or square tube 44 having two pair of opposing sidewalls 46, 47. The guide 40 has an entry portion 48 and an exit portion 50. The entry portion 48 is the part of the guide 40 that receives strap material S from the dispenser 10 while the exit portion 50 is the part of the guide 40 from which the strap S from the guide 40 traveling to the strapper 20.

Mounted to the sidewalls 46, 47, internal to the tube 44, are a plurality of guide elements 52. The guide elements 52 are bearing surfaces and can be, for example, pin rollers or pin bearings. The guiding elements 52 can be mounted to the sidewalls 46 such that they define at least a portion of the inner most periphery of the sidewalls 46 to further define the pathway for the strap material S. The guide elements 52 are preferably located at the exit 50, and more preferably, the guide elements 52 are located at the entry 48 and the exit 50.

As strap is fed from the spool 14 it comes off of the spool tangential or "normal" to the spool 14. The strap is threaded through the take up element 16 and enters the guide 40. The guide 40 is preferably positioned normal to the spool along a radial plane with the take up element 16. The guide 40 is mounted to the frame 12 and receives strap material S from the take up element 16. The strap material S enters the guide sleeve 42 at the entry portion 48 and is guided through the pathway defined by the guide elements 52.

Generally, the strapper 20 is positioned normal to the dispenser 10 and the guide 40. In this manner, the strap S runs generally in a single plane from the dispenser 10 to the strapper 20. However, in some circumstances, it may be desirable to orient the strapper 20 in a different planar position, or to orient the dispenser 10 in a different planar position. In such cases, the strap material S still comes off of the spool 14 and into the take up element 16 and into the guide 40 in a planar manner. The guide 40 permits this planar feeding from the spool 14, through the take up element 16 and into the guide 40 and permits the strap material S to be drawn from the guide 40 in a wide ranges of angles and number of directions from up to about 90 degrees left or right of normal, up and down. Thus, if the strapper 20 is located in another plane other than normal, the strap material S will pass through the guide 40, and traverse over one or more of the guide elements 52.

At times, the guide 40 will not be directly in line with the strap material S as it is fed from the dispenser 10. It is therefore preferable to have guide elements 52 on the interior of the entrance portion 48 of the guide 40 to guide the strap material S into the hollow element 42, and at the exit 50 to accommodate the strap leaving the guide 40 at an angle. In a present embodiment, the guide elements 52 are bearings. As the strap material moves through the guide 40, it moves against the bearings, which rotate and allow the strapping material S to pass through the pathway with little to no resistance and no contact with any sharp or abrasive surfaces. These surfaces lessen the amount of friction applied to the strap material S and preclude rubbing against any abrading surfaces, making it less likely that the strapping material will be worn or frayed. Essentially, the innermost peripheral plane defined by the guide 40 is formed by the elements 52. In this manner, the strap does not contact a wall 46, 47 of the guide 40, but contacts one or more guide elements 52. Thus, the strap is prevented from contacting a possibly sharp or abrading surface, but contacts only a bearing surface (roller) 52. It will be appreciated from a study of the figures that the inner periphery 54 of the guide 40, at the entrance 48 and exit 50 are composed (and preferably entirely) of the element 52 surfaces.

Figure 4:
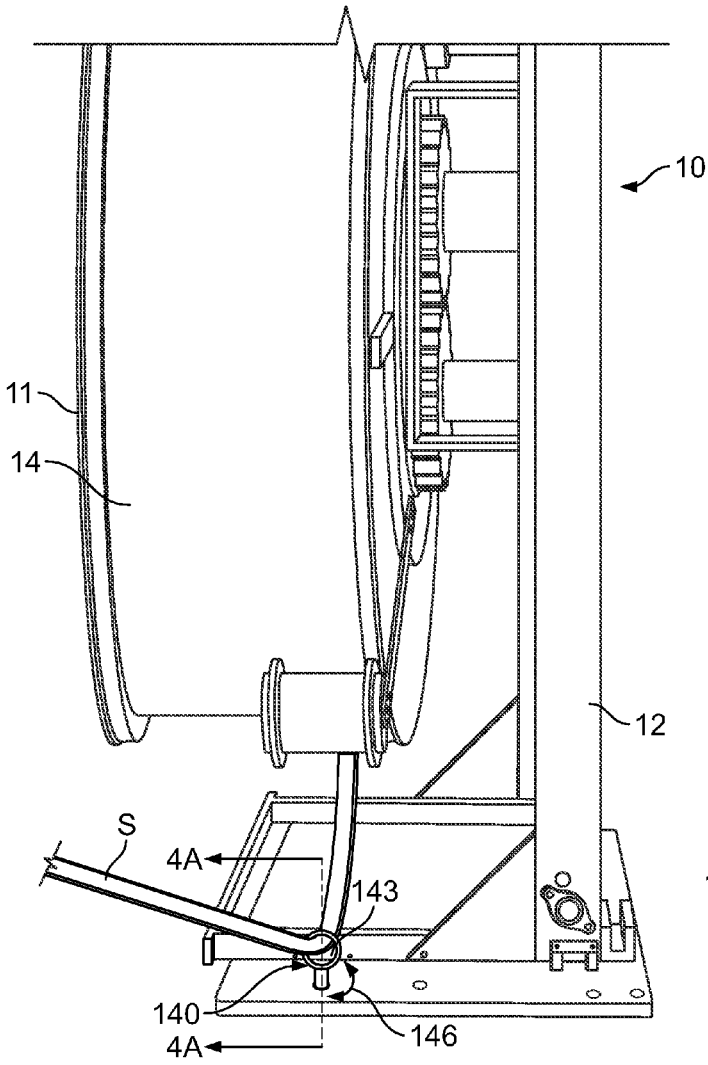
FIG. 4 is a view similar to FIG. 2, illustrating an alternate embodiment of the multi direction strap payoff guide in accordance with the present invention.

An alternate embodiment of the guide 140 is illustrated in FIG. 4. In this embodiment, the guide 140 is formed as a ring or toroid having a rounded or circular configuration with an open central passage 143 and having rounded (bearing) surfaces (as indicated at 142) formed in the guide ring 140. The guide 140 can be fixed to the base 144 of the frame 12 of the dispenser 10, or it can be configured to rotate, as indicated by the arrow at 146. The guide 140 has an entry side 148 and an entry side 150.

Figure 4A:
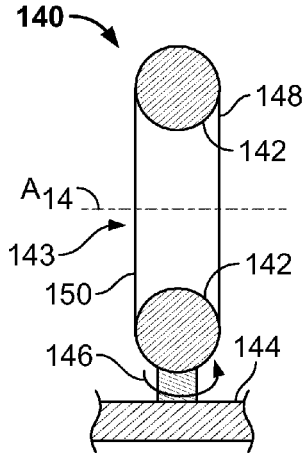
FIG. 4A is a cross-sectional view taken along line 4A-4A of FIG. 4.

Two or more guides 40, 140 may be employed to help transfer the strap material S from the dispenser 10 to the strapper 20. A first guide 40, 140 may be positioned near the dispenser 10, for example, mounted to the dispenser 10 at a point near where the strap material S is fed from the spool 14. A second guide 40 can be positioned near the strapper 20, for example, mounted to the strapper 20 near where the strap is fed into the strapper. The strap material S enters the entry portion 48 of the second guide 40, 140 and passes over the guide elements 52 as it changes from an entry direction to one parallel to a length L or central axis $A_{140}$ (as seen in FIG. 4A) of the guide 40, 140. The second guide 40, 140 is orientated such that the strap is fed from the exit portion 50 in a direction that is optimal for the strapper 20.

In the disclosures, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A guide for directing strap material from a dispenser to a strapper, the guide comprising:

a hollow element having an open central passage capable of allowing strap material to pass therethrough, the hollow element having an entry portion and an exit portion, the exit portion having internal exit portion bearing elements that define an inner periphery of the passage, wherein the guide is capable of allowing the strap material to enter the passage at the entry portion in one direction and exit the passage at the exit portion in a second direction wherein the entry portion has internal entry portion bearing elements and wherein the entry portion internal bearing elements are pin rollers mounted to the sidewalls.

2. The guide in accordance with claim 1, wherein the hollow element is a rectangular tube comprising two pairs of opposing sidewalls.

3. The guide in accordance with claim 2, wherein the exit portion bearing elements are disposed adjacent the sidewalls.

4. The guide in accordance with claim 3, wherein the exit portion bearing elements are pin rollers mounted to the sidewalls.

5. The guide in accordance with claim 1, wherein the exit portion bearing elements extend substantially about an entirety of an inner periphery of the hollow element at the exit portion.

6. A guide for directing strap material from a dispenser to a strapper, the guide comprising:

a hollow element having an open central passage capable of allowing strap material to pass therethrough, the hollow element having an entry portion and an exit portion, the exit portion having internal exit portion bearing elements that define an inner periphery of the passage, wherein the guide is capable of allowing the strap material to enter the passage at the entry portion in one direction and exit the passage at the exit portion in a second direction wherein the entry portion has internal entry portion bearing elements and wherein the entry portion bearing elements extend substantially about an entirety of an inner periphery of the hollow element at the entry portion.

7. A guide for directing strap material from a dispenser to a strapper, the guide comprising:

a hollow sleeve-like element having an open central passage for carrying strap material passing therethrough, the sleeve-like element having an entry and an exit, the exit having a exit bearing surface that defines an inner periphery of the passage, wherein strap material enters the passage at the entry and exits the passage at the exit, and wherein strap material is directed, as it exits the passage, by the exit bearing surface wherein the exit bearing surface is defined by a plurality of exit pin bearings mounted in an inner periphery of the element at about the exit.

8. The guide in accordance with claim 7 wherein the exit pin bearings extend substantially about an entirety of the inner periphery of the element.

9. The guide in accordance with claim 7, wherein the entry includes an entry bearing surface in the inner periphery of the element at about the entry.

10. The guide in accordance with claim 9, wherein the entry bearing surface is defined by a plurality of entry pin bearings mounted in the inner periphery of the element at about the entry.

11. The guide in accordance with claim 10 wherein the entry pin bearings extend substantially about an entirety of the inner periphery of the element at the entry.

* * * * *